US008029124B2

(12) United States Patent
Cellura et al.

(10) Patent No.: US 8,029,124 B2
(45) Date of Patent: Oct. 4, 2011

(54) SYSTEM AND METHOD FOR ENCAPSULATING EDGES OF PAPER IN PRINTERS

(75) Inventors: Mark A. Cellura, Webster, NY (US); Elliott A. Eklund, Penfield, NY (US); Jim Casella, Webster, NY (US); Michael J. Levy, Webster, NY (US); Scott Phillips, West Henrietta, NY (US); Roger Leighton, Rochester, NY (US); Michael Leo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 551 days.

(21) Appl. No.: 12/134,803

(22) Filed: Jun. 6, 2008

(65) Prior Publication Data

US 2009/0303305 A1 Dec. 10, 2009

(51) Int. Cl.
*B41J 2/01* (2006.01)

(52) U.S. Cl. ..... 347/101

(58) Field of Classification Search ..... 347/101; 399/98

See application file for complete search history.

(56) References Cited

U.S. PATENT DOCUMENTS

| | | | | |
|---|---|---|---|---|
| 7,123,854 | B1 | 10/2006 | Cellura et al. | 399/92 |
| 7,266,324 | B2 * | 9/2007 | Yanagida et al. | 399/100 |
| 2006/0165431 | A1 * | 7/2006 | Yanagida et al. | 399/100 |
| 2007/0014588 | A1 * | 1/2007 | Yanagida et al. | 399/100 |
| 2007/0040886 | A1 | 2/2007 | Cellura et al. | 347/103 |

* cited by examiner

*Primary Examiner* — Huan Tran

(74) *Attorney, Agent, or Firm* — Luis M. Ortiz; Kermit D. Lopez; Ortiz & Lopez, PLLC

(57) ABSTRACT

System and method for encapsulating edges of a paper in digital printing systems. A spray applicator can include a set of stationary sprayers with spray nozzles, a set of transfer rollers and an inkjet print head. The stationary sprayers can be positioned at both marginal ends of the paper. The stationary sprayers apply the fluid through the spray nozzles at edges of the moving paper to encapsulate the edges of the paper such that loose paper fibers and debris are bound to the paper. The fluid can be applied when the transfer rollers can pass the moving paper through a printer or printing press. Thus, the system can protect various subsystems of the printer or printing press against contamination due to the loose paper fibers and debris.

16 Claims, 4 Drawing Sheets

SYSTEM AND METHOD FOR ENCAPSULATING EDGES OF PAPER IN PRINTERS

TECHNICAL FIELD

Embodiments are generally related to digital printing systems or printing presses. Embodiments are more particularly related to a system and method for encapsulating edges of a paper in printers. Embodiments are additionally related to spray applicators with stationary sprayers for reducing paper debris in the printers.

BACKGROUND OF THE INVENTION

In printing industries, papers used in digital printing systems can require adherence to stringent quality standards. Such printing paper can withstand physical extremes such as high heat, pressure and electrical charge without curling or loss of dimensional stability. Also, the image quality of the printing paper should be maintained throughout printing, finishing and binding processes. Such paper is ideally free of paper dust, loose fibers, and other particle debris, which can cause contamination of the imaging process in the printing systems and also cause image quality problems.

The majority of paper-borne debris is generated from cut edges of the paper, which are particularly problematic with higher contaminates due to cutting and slitting of the paper during manufacturing. The cut quality can yield lesser amounts of paper debris, since the quantity of the paper debris is directly proportional to the quality of the cut. Such cut quality can be determined largely by the sharpness of the blade. Paper debris in Xerographic printing can cause problems in the paper path and finishing areas, which lead to a significant noise input affecting printing system reliability. Similarly, the debris in ink jet printing can cause print head jetting failures (such as paper clumping with ink jets), which result in image quality defects such as streaks, drop-out, etc. Paper debris can also adversely affect the development operation in the printing systems and subsequently the image quality of the paper.

In some prior art inkjet printing, vacuum devices are utilized in the printing systems to prevent inkjet failures due to paper dust, loose fibers and debris in inkjet printers, especially in and around inkjet print heads. In addition, larger xerographic printing systems can also utilize vacuum devices for cleaning web-fed paper paths and a residual toner from the surface of a photoreceptor drum in order to avoid image quality defects due to paper dust particles. Furthermore, a vacuum pump, fan and other air movement device can also be provided within the printing machine to remove the paper debris and dust. Such vacuum abatement systems can prevent contaminants from reaching critical printer components, but the drawback is the creation of additional resistance to abatement airflow by connecting ducts. The connecting ducts can add complexity and cost for degrading the airflow in the abatement system, since the connecting ducts consist of several components and connections.

In the majority of prior art, several types of paper debris abatement systems can be utilized to provide an effective means for removing unwanted debris from paper in its path. But, such abatement systems can exhibit substantial limitations for removing contaminating particles, especially for high volume printing. The abatement system also increases the production expenses of the printing systems. In addition, these abatement systems can exhibit a rotating brush and bristles can contact the paper to brush the surface of the web, which affects the physical property of the printing paper. For large printing applications, it is usually not cost effective to solve the paper debris problem by lightly scrubbing the paper and vacuuming away the loose debris. Then, it is highly desirable to reduce the paper debris for successful optimization of the printing paper for digital printing systems and processes without increasing the production cost.

A need therefore exists for an improved system and method for encapsulating edges of a printing paper, which avoids contamination of various subsystems of the printer or printing press due to paper debris. Such an improved method is described in greater detail herein.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved system and method for encapsulating edges of paper used in printers.

It is another aspect of the present invention to provide for a spray applicator with stationary sprayers for reducing paper debris in the printers.

The aforementioned aspects and other objectives and advantages can now be achieved as described herein. An improved system and method for encapsulating edges of paper or a paper web ("paper") in digital printing systems. A spray applicator can include a set of stationary sprayers with spray nozzles, a set of transfer rollers and an inkjet print head. The stationary sprayers can be positioned at both marginal ends of the paper web. The stationary sprayers apply the fluid through the spray nozzles at edges of the moving paper to encapsulate the edges of the paper such that loose paper fibers and debris are bound to the paper. The fluid can be applied when the transfer rollers can pass the moving paper through a printer or printing press. Thus, the system can protect various subsystems of the printer or printing press against contamination due to the loose paper fibers and debris.

Furthermore, the fluid encapsulation can be envisioned in a non-printing area at and near the paper edge and also done by a paper manufacturer. The fluid is applied before the transfer rollers transfer the paper to the inkjet print head along a paper path. The fluid can be a wax based solution, water, oil, a clear paint, or a varnish. The stationary fluid sprayers, the transfer rollers and the inkjet print head can be electrically controlled using a micro controller.

In addition, the spray applicator can also be utilized on an iGen, which is a sheet-fed dry toner digital press. The spray or fluid solution on the iGen is applied as a primer so that the different printers can print over the output generated by the iGen press. The spray applicator utilizes the airbrush spray nozzle and a wax based solution, especially in the iGen press, which executes the existing production hardware to apply a coating at the paper edges. Thus, the image quality and printer reliability can practically be enhanced without increasing the printing process and the production cost.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
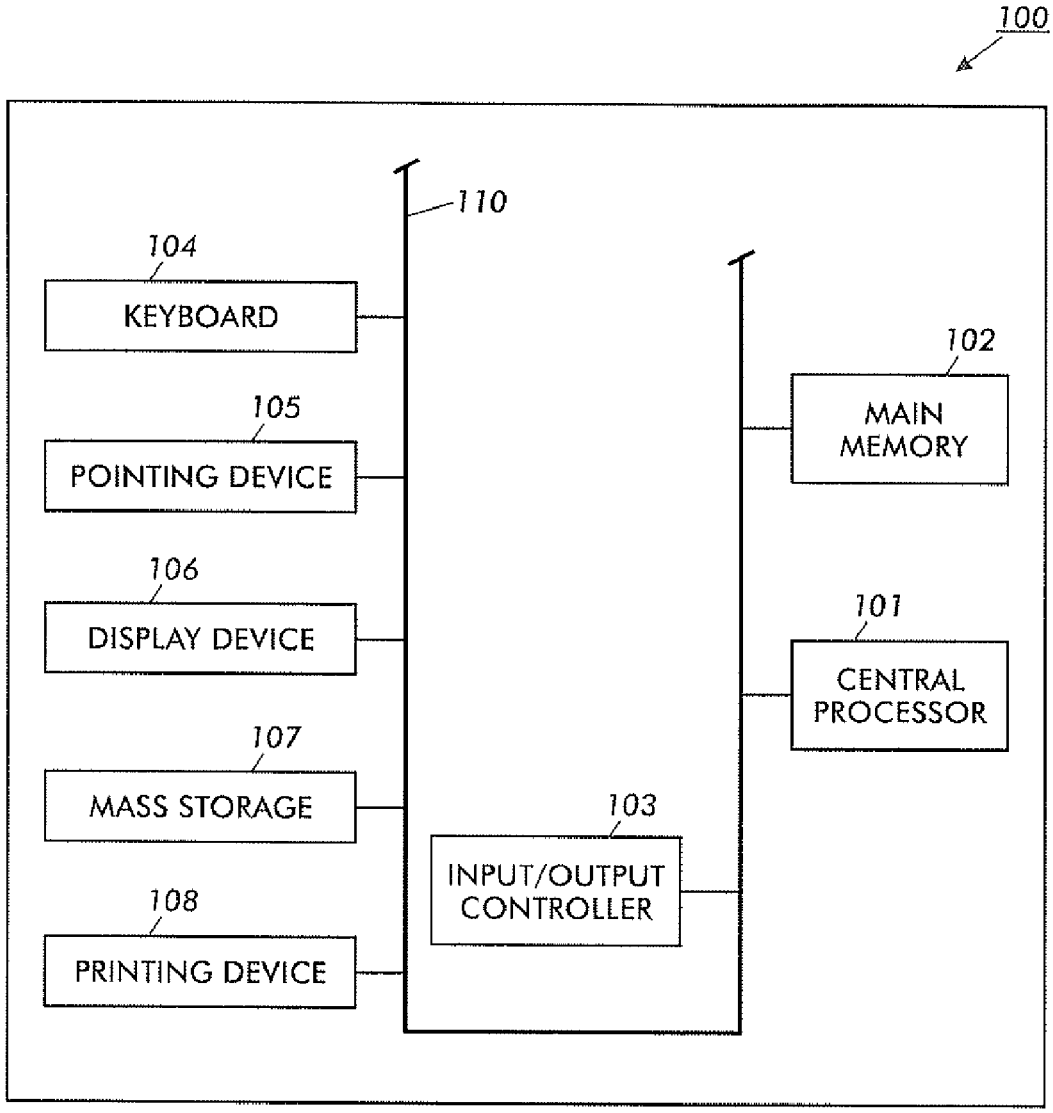
FIG. 1 illustrates a schematic view of a computer system in which the present invention may be embodied.

FIG. 1 is provided as exemplary diagrams of data processing environments in which embodiments of the present invention may be implemented. It should be appreciated that FIG. 1 is only exemplary and is not intended to assert or imply any limitation with regard to the environments in which aspects or embodiments of the present invention may be implemented. Many modifications to the depicted environments may be made without departing from the spirit and scope of the present invention.

As depicted in FIG. 1, the present invention may be embodied in the context of a data-processing apparatus 100 comprising a central processor 101, a main memory 102, an input/output controller 103, a keyboard 104, a pointing device 105 (e.g., mouse, track ball, pen device, or the like), a display device 106, and a mass storage 107 (e.g., hard disk). The present invention mainly focuses on additional input/output devices, such as a printing device 108, that may be included in the data-processing apparatus 100 as desired. The printing device 108 can be implemented with a spray application for reducing paper debris in accordance with the embodiments of the present invention. As illustrated, the various components of the data-processing apparatus 100 communicate through a system bus 110 or similar architecture.

The following description is presented with respect to embodiments of the present invention, which can be embodied in the context of a data-processing apparatus 100 depicted in FIG. 1. The present invention, however, is not limited to any particular application or any particular environment. Instead, those skilled in the art will find that the system and methods of the present invention may be advantageously applied to a variety of system and application software, including database management systems, word processors, and the like. Moreover, the present invention may be embodied on a variety of different platforms, including Macintosh, UNIX, LINUX, and the like. Therefore, the description of the exemplary embodiments which follows is for purposes of illustration and not considered a limitation.

Figure 2:
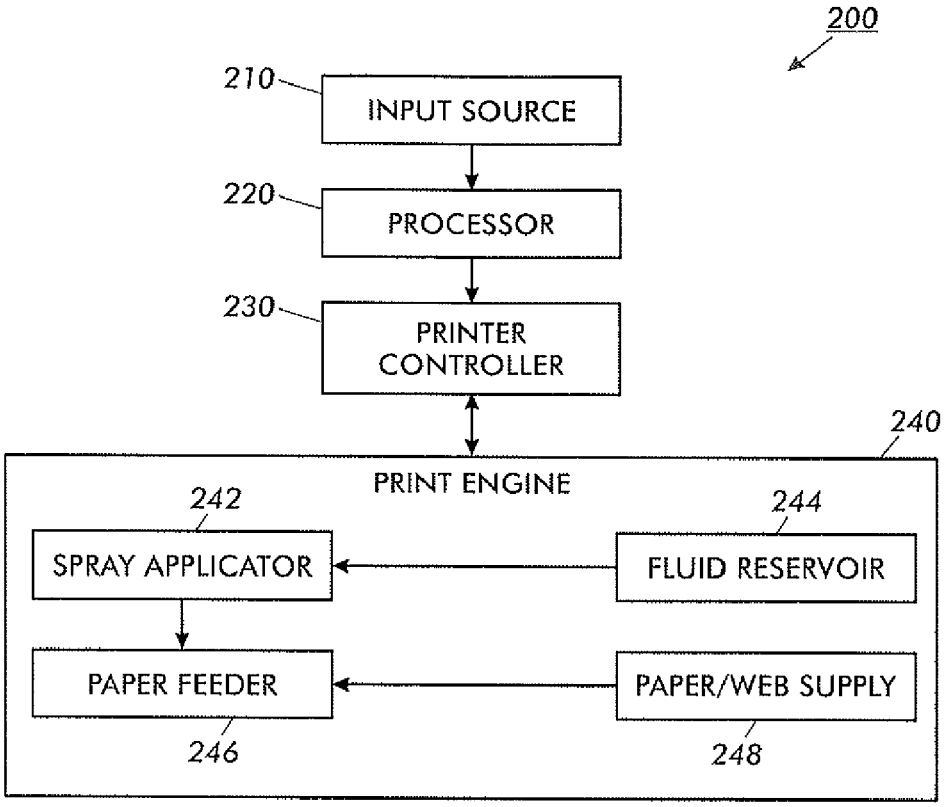
FIG. 2 illustrates a block diagram of a structure of a printing device as shown in FIG. 1, which can be implemented in accordance with a preferred embodiment.

Referring to FIG. 2 a block diagram of a structure of a printing device 200 as shown in FIG. 1 is illustrated, which can be implemented in accordance with a preferred embodiment. The printing device 200 can electrically be connected to the central processor 101 of the data-processing apparatus 100. The printing device 200 includes an input source 210, a processor 220, a printer controller 230 and a print engine 240. The printing device 200 is adapted for reading print type information received together with printer data from the input source 210, and for performing a print job corresponding to a set print type. The processor 220 can convert the received print data into image data suitable for the print engine 240. The print engine 240 prints an image corresponding to image data transferred from the printer controller 230.

The printer controller 230 includes multiple key options for selecting various printing functions provided by the printing device 200. The printer controller 230 can read data transferred from the computer (not shown) and control the printing of the print engine 240 in accordance with the set print type. The printer controller 230 informs the user through a display device (not shown) and/or a sound output device (not shown). The print engine 240 can consist of a spray applicator 242, a fluid reservoir 244, a paper feeder 246 and paper/paper web supply 248. The spray applicator 242 can receive fluid from the fluid reservoir 244 based on the control signal produced by the printer controller 230. The spray applicator 242 can apply the fluid on a non-printing area of the paper 248 to remore paper debris, when the paper 248 is fed for printing by the paper feeder 246. The print engine 240 can print an image corresponding to the converted image data to the paper 248 after the application of fluid on the paper 248. The print engine 240 has various structures corresponding to different printing methods. The print engine 240 can additionally include an optical scanner (not shown) for scanning light to a photosensitive medium.

Figure 3:
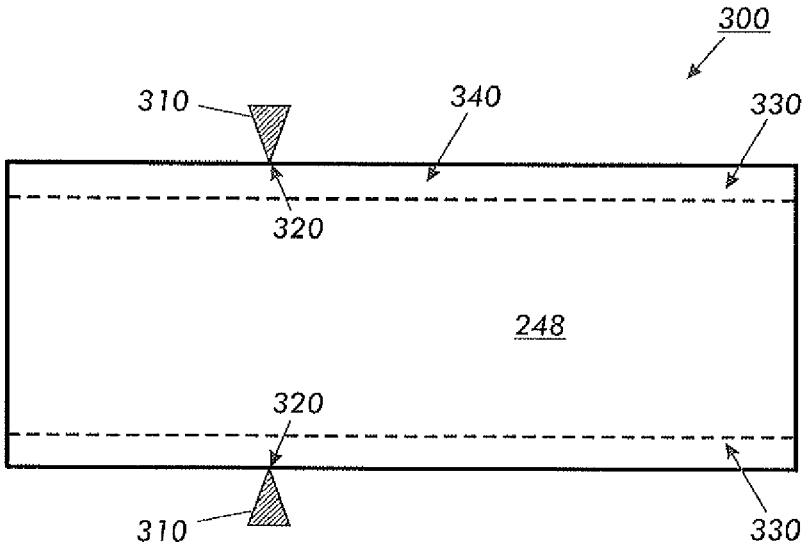
FIG. 3 illustrates a schematic diagram of an arrangement of a spray applicator, which can be implemented in accordance with a preferred embodiment.

Referring to FIG. 3 a schematic diagram of an arrangement of a spray applicator 300, which can be implemented in accordance with a preferred embodiment. The spray applicator 300 can be arranged at both ends of the paper 248, and include stationary fluid sprayers 310 with spray nozzles 320. The stationary fluid sprayers 310 are directly connected with the fluid reservoir 244 in order to receive the fluid 340 from it. The stationary fluid sprayers 310 can be adapted to encapsulate the edges of the paper 248 such that loose paper fibers and particles are bound to the paper. Such stationary fluid sprayers 310 avoid contamination of the various subsystems of the printing device 200 due to the paper debris.

Figure 4:
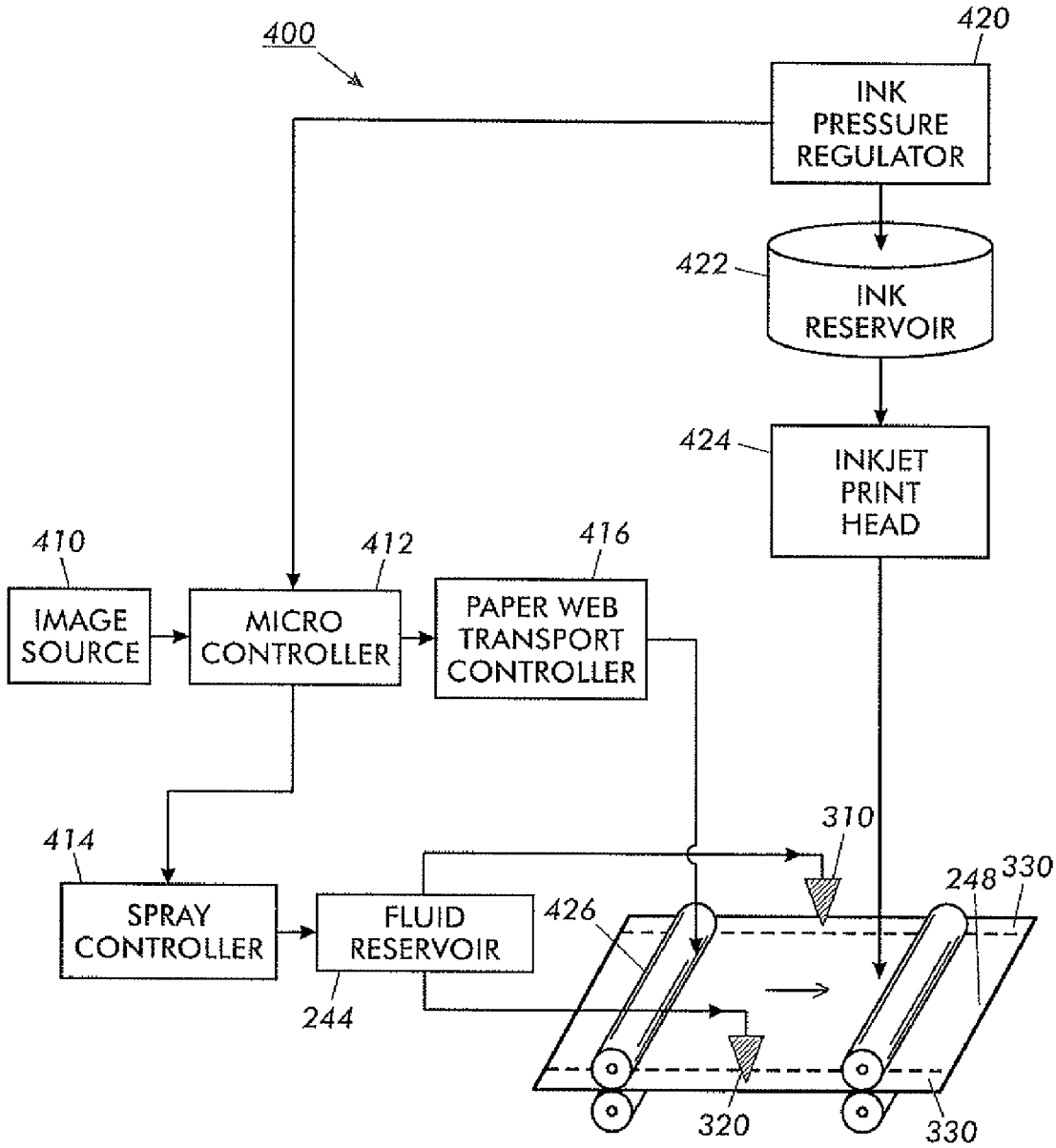
FIG. 4 illustrates a simplified block diagram of an inkjet printing apparatus arranged with the spray applicator as shown in FIG. 3, which can be implemented in accordance with an alternative embodiment.

The stationary sprayers 310 can apply the fluid or spray 340 to the edges, i.e. spray regions 330, of the moving paper 248 via the spray nozzles 320. The spray nozzles 320 can be opened and closed based on the instructions generated by the printer controller 230. The fluid or spray 340 can be a wax based solution, water, oil, a clear paint, or a varnish. The fluid encapsulation can be envisioned in the spray regions 330 at and near the edge of the moving web 248. The fluid can be applied as early as possible, i.e. the moving web 248 before reaching an inkjet print head 440 as shown in FIG. 4. The spray application can also be done on the paper 248 by the paper manufacturer, especially for digital printing process.

Furthermore, the spray applicator 300 can also be utilized on an iGen (not shown), which is a sheet-fed dry toner digital press. The spray or fluid solution 340 on the iGen is applied as a primer so that the different printers can print over the output generated by the iGen press. The spray applicator 300 utilizes the airbrush spray nozzle 320 and a wax based solution 340 for prototyping, especially in the iGen press, which executes the existing production hardware to apply a coating at the paper edges. Such spray applicator 300 provides a successful fluid encapsulation of the paper edge contamination in a cost-effective manner. Therefore, the image quality and printer reliability can practically be enhanced without increasing the printing process time.

Referring to FIG. 4 a simplified block diagram of an inkjet printing apparatus 400 arranged with the spray applicator 300 as shown in FIG. 3, which can be implemented in accordance with an alternative embodiment. The inkjet printing apparatus 400 includes an image source 410, a micro controller 412, a spray controller 414, a paper web transport controller 416, an ink pressure regulator 420, an ink reservoir 422, and a spray applicator 300. The image source 410 can be a scanner or computer, which provides raster and outline image data in the form of a page description language. The micro controller 412 provides a control signal to various subsystems in relation to the image data received from the image source 410. The micro controller 412 can control various mechanical operation aspects of the printing apparatus 400, and also decode the information received from the computer (not shown).

The spray controller 414, the paper web transport controller 416 and the ink pressure regulator 420 are electrically connected with the micro controller 412 to receive the appropriate control signals for printing operation. The spray controller 414 can transmit control instructions to the fluid reservoir 244, in particular about the fluid quantity to be supplied to the stationary sprayers 310 of the spray applicator 300. The stationary sprayers 310 can spray the supplied quantity of fluid on the non-printing regions 330 of the paper web 248 through the spray nozzles 320. The stationary sprayers 310 should be arranged in front of an inkjet print head 424, i.e. before the printing to be done on the paper 248. Simultaneously, the paper web transport controller 416 provides control instructions to a set of transfer rollers 426 in order to pull the paper 248 from the tray or paper feeder 246.

Furthermore, the ink reservoir 422 contains printing ink under pressure condition. The ink pressure regulator 420 is connected with the ink reservoir 422 to provide the appropriate pressure for facilitating transfer of the ink drops to the paper 248 through the inkjet print head 424. The inkjet print head 424 is fabricated from silicon and contains a series of nozzles (not shown) that are used to spray drops of ink on the paper 248. The inkjet print head 424 can receive the regulated ink from the ink reservoir 422 in relation to the ink pressure regulator 420, so that the series of nozzles can drop the ink in the appropriate position of the paper 248 designated by the micro controller 412.

Figure 5:
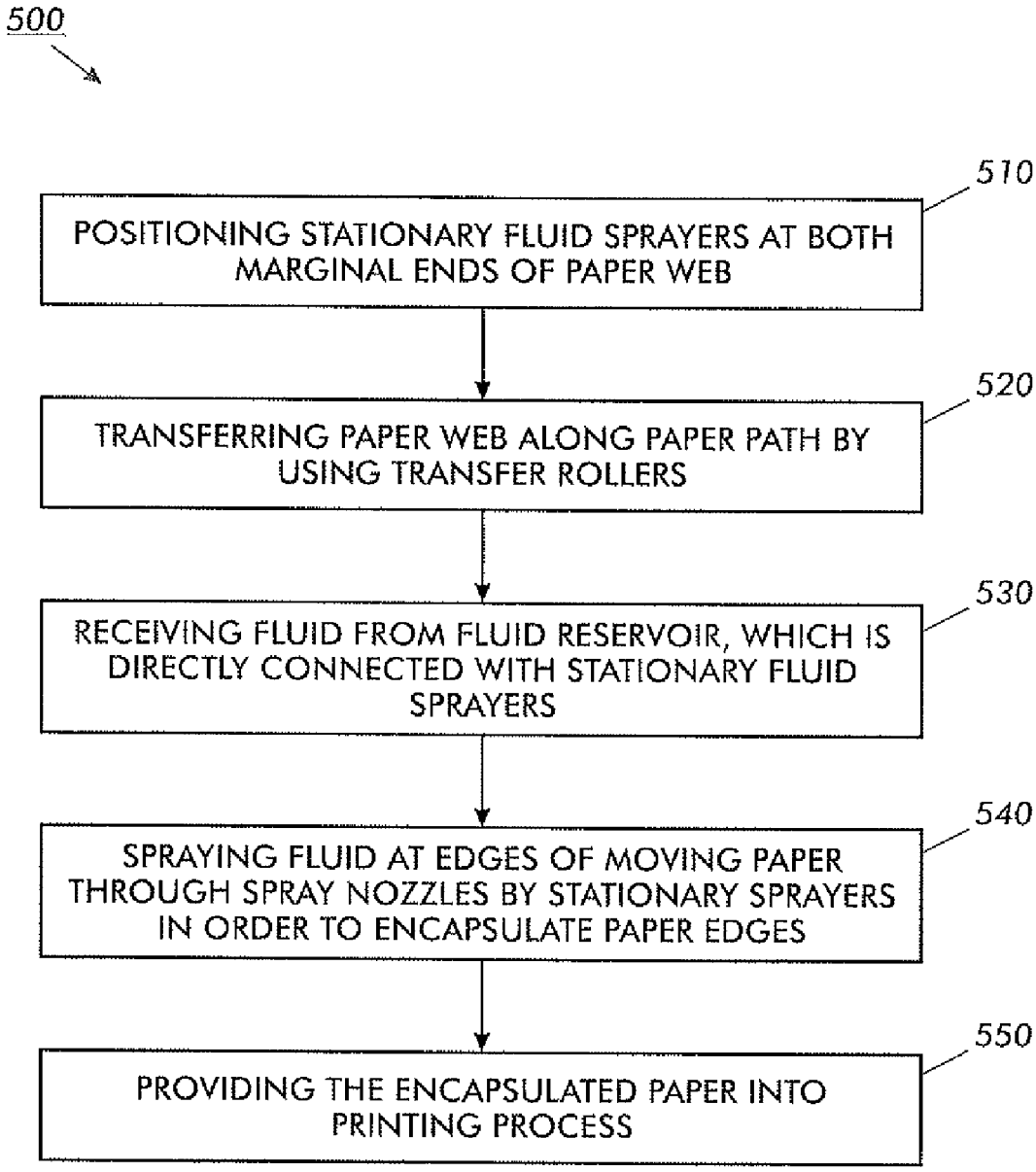
FIG. 5 illustrates a flowchart of a method for encapsulating edges of a paper web in the inkjet printing apparatus, which can be implemented in accordance with an alternative embodiment.

Referring to FIG. 5 a flowchart of a method 500 for encapsulating edges of a paper 248 in the inkjet printing apparatus 400, which can be implemented in accordance with an alternative embodiment. As illustrated at block 510, a set of stationary fluid sprayers 310 is provided at both marginal ends of the paper 248 to be printed. As depicted at block 520, the paper 248 can be transferred along a paper path (not shown) by using the transfer rollers 426. As mentioned at block 530, the fluid 340 is received from a fluid reservoir 244, which is directly connected with the stationary fluid sprayers 310. The fluid 340 can be a wax based solution, water, oil, a clear paint, or a varnish.

Thereafter, as depicted at block 540, the fluid 340 can be sprayed at edges of the moving paper 248 through spray nozzles 320 by using the stationary sprayers 310 in order to encapsulate the edges of the moving paper 248 such that loose paper fibers and debris are bound to the moving paper 248. The fluid 340 is applied before the transfer rollers 320 can transfer the paper 248 to the inkjet print head 424. The fluid encapsulation can be envisioned in a non-printing area 330 at and near the paper edge. The stationary fluid sprayers 310, the transfer rollers 426 and the inkjet print head 424 can be electrically controlled using the micro controller 412. Finally, as illustrated at block 550, the encapsulated paper 248 can be provided into a printing process. Thus, the method 500 protects the various subsystems of the inkjet printing apparatus 400 against contamination due to the loose paper fibers and debris.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system for encapsulating edges of a paper web in printers or printing presses, said system comprising:

a plurality of transfer rollers is adapted for transferring paper into a printer or printing press along a paper path; and a plurality of stationary sprayers is positioned at both marginal ends of said paper, wherein said plurality of stationary sprayers applies a spray solution via a plurality of spray nozzles at edges of said paper to encapsulate said edges of said paper such that loose paper fibers and debris are bound to said paper.

2. The system of claim 1 wherein said spray solution comprises a wax based solution, water, oil, a clear paint and/or a varnish.

3. The system of claim 1 wherein said plurality of spray nozzles comprises an airbrush spray nozzle.

4. The system of claim 1 wherein said plurality of stationary sprayers and said plurality of transfer rollers are incorporated into a spray applicator.

5. The system of claim 1 wherein said spray solution is applied when said plurality of transfer rollers passes said paper through said printer or printing press.

6. The system of claim 4 wherein said spray applicator is utilized on an iGen, which is a sheet-fed dry toner digital press.

7. The system of claim 6 wherein said spray solution on said iGen is applied as a primer so that any printer prints over an output generated by said iGen.

8. Said system for encapsulating edges of a paper web in printers or printing presses in claim 1, further comprising at least one inkjet print head adapted for printing image data on said paper after said paper is encapsulated by said spray solution, wherein paper encapsulation is executed in a non-printing region of printers or printing presses at and near said paper edges.

9. The system of claim 8 wherein said inkjet print head is incorporated in a printing system after said plurality of stationary sprayers utilized for applying encapsulation to paper edges.

10. A system for encapsulating edges of a paper web in printers or printing presses, said system comprising:

a plurality of transfer rollers is adapted for transferring paper into a printer or printing press along a paper path;

a plurality of stationary sprayers is positioned at both marginal ends of said paper, wherein said plurality of stationary sprayers applies a spray solution via a plurality of spray nozzles at edges of said paper to encapsulate said edges of said paper such that loose paper fibers and debris are bound to said paper; and an inkjet print head adapted for printing image data on said paper after said paper is encapsulated by said spray solution, wherein paper encapsulation is executed in a non-printing region of printers or printing presses at and near said paper edges.

11. The system of claim 10 wherein said spray solution comprises a wax based solution, water, oil, a clear paint and/or a varnish.

12. The system of claim 10 wherein said plurality of spray nozzles comprises an airbrush spray nozzle.

13. The system of claim 9 wherein said plurality of stationary sprayers, said plurality of transfer rollers and said inkjet print head are incorporated into a spray applicator.

14. The system of claim 10 wherein said spray solution is applied when said plurality of transfer rollers passes said paper through said printer or printing press.

15. The system of claim 13 wherein said spray applicator is utilized on an iGen, which is a sheet-fed dry toner digital press.

16. The system of claim 15 wherein said spray solution on said iGen is applied as a primer so that any printer prints over an output generated by said iGen.

* * * * *